US005338572A

United States Patent [19]

Montagna

[11] Patent Number: 5,338,572

[45] Date of Patent: Aug. 16, 1994

[54] INDUSTRIAL PROCEDURE FOR THE APPLICATION OF A P.T.F.E. FILM ON ALUMINUM SURFACES

[75] Inventor: Michele Montagna, Pesaro, Italy

[73] Assignee: Alluflon- S.p.A., Mondavio, Italy

[21] Appl. No.: 156,793

[22] Filed: Nov. 23, 1993

Related U.S. Application Data

[63] Continuation of Ser. No. 969,424, Oct. 30, 1992, abandoned.

[51] Int. Cl.[5] ..... B05D 3/04

[52] U.S. Cl. ..... 427/309; 427/327; 427/365; 427/402; 427/428

[58] Field of Search ..... 427/309, 327, 365, 428, 427/402

[56] References Cited

U.S. PATENT DOCUMENTS

| | | | |
|---|---|---|---|
| Re. 22,296 | 3/1943 | Shoemaker | 427/327 |
| 2,923,640 | 3/1956 | Buckingham | 427/327 |
| 3,243,321 | 3/1966 | Rowand | 427/327 |
| 4,028,205 | 6/1977 | Dorsey, Jr. | 427/327 |

*Primary Examiner*—Shrive Beck
*Assistant Examiner*—Benjamin Utech
*Attorney, Agent, or Firm*—Leonard Bloom

[57] ABSTRACT

A procedure for the application of a polytetrafluoroethylene film on aluminum surfaces by means of mechanical-chemical bonding using a specific compound which, on one hand can adhere to a smooth aluminum surface and, on the other hand, being suitable for producing mechanical-chemical bonding with the P.T.F.E. The aluminum surface is cleaned with an aqueous alkaline solution and the compound applied by a rolling process using four rolling machines.

6 Claims, No Drawings

INDUSTRIAL PROCEDURE FOR THE APPLICATION OF A P.T.F.E. FILM ON ALUMINUM SURFACES

This application is a continuation of U.S. patent application Ser. No. 07/969,424, file Oct. 30, 1992, now abandoned.

This patent application concerns an industrial procedure for the application of a polytetrafluoroethylene film on aluminum surfaces by means of mechanical-chemical bonding using a specific compound.

In order to understand and appreciate the characteristics and advantages of the procedure according to the invention, some mention must be made of the technology used to date for covering metal surfaces with P.T.F.E. (polytetrafluoroethylene) film, which is more commonly known under its commercial name of "TEFLON".

P.T.F.E. is an organic compound which can continuously resist temperatures of up to 250° C. or temperatures of up to 400° C. for shorter periods of time.

This property, together with its excellent non-adhering qualities has resulted in its extensive use in the production of cooking pots and pans and crockery used in the home and for all those articles which require easy cleaning and resistance to high temperatures.

If on one hand the non-adhering quality of this organic compound makes the items on which it is used easy to clean, on the other hand, this very quality creates the problem of how to adhere the P.T.F.E. to the surfaces treated, since P.T.F.E. is very difficult to bond chemically to all other materials, in particular with aluminium, glass or ceramics, which are the materials principally used for manufacturing kitchenware.

Despite this, it has been proved that it is possible to adhere P.T.F.E. to an aluminium surface if the latter is roughened so as to provide a mechanical hold for the film of P.T.F.E.

One of the most common and widely used methods for roughening this material consists of chemical pickling which attacks the metal surface which is to be coated, with NaOH (sodium hydroxide, commonly known as caustic soda) and HCl (hydrochloric acid).

In the production of aluminium pots and pans, the metal disks, in various diameters and thickness, are dipped in a bath of NaOH to be degreased and then in successive baths of HCl which attacks the metal surface thereby making it rough, and covering the same with micro-cavities so that it provides the required mechanical hold.

P.T.F.E. is sprayed on the surface of the disk in an aqueous solution to ensure its penetration in the pores produced by the previous pickling treatment; the disk is then placed in kilns, where the P.T.F.E. is sintered at a temperature of 370° C.; once the P.T.F.E. has solidified it is trapped in the micro-cavities on the metal surface. The above system is commonly used in the manufacture of pots and pans; the system used consists of a pickling procedure whereby the disks are first placed into treatment tanks and are then rinsed and dried and then transported to a series of "rolling machines" which apply the layer of P.T.F.E. with a lithographic type technique.

Each rolling machine consists of two rollers, one of which is in metal and the other in rubber, which rotate touching each other, with the aqueous solution of P.T.F.E. running over them; the bottom side of the rubber roller touches the pickled disks and uniformly distributes the P.T.F.E. solution on the same.

In order to increase the thickness of the layer of P.T.F.E. coating, a set of rolling machines is used by means of which the disk receives successive coats of the product, between which it is dried; in general, there are four rolling machines on each of which is applied the aqueous solution of P.T.F.E. with the addition of pigments.

The above procedure consists of a thorough pickling of the aluminium which causes large quantities of metal to be removed and which remain bound to the acids and the bases of the baths, very quickly depleting their corrosive properties.

The solution in the tank must therefore be replaced very frequently and the depleted solution must be processed through purifying systems before being drained in the sewage system.

In view of the fact that water and mud containing aluminium salts in an amount directly proportional to the amount of aluminium in the solution are obtained from the purification of depleted solutions, the discharge of the these muds in the sewage system increases the overall management costs of the purification system, which in itself is very high.

The purpose of this invention is to design a new industrial process for coating aluminium surfaces with P.T.F.E. more quickly, cheaply and with less pollution with respect to the above, thanks to the fact that no deep pickling treatment is required for roughening the surface.

The procedure according to the invention involves the coating on a previous degreased metal surface of a product (P), on one hand adhering to a smooth aluminium surface and on the other permitting the formation of a mechanical-chemical bonding with the P.T.F.E.

This new industrial procedure consists of the following phases: the metal surface is degreased with NaOH (sodium hydroxide) which removes all oxides and/or grease, which would compromise the efficiency of the successive treatments; it should be remembered that aluminium is chemically reactive to soda, so that the surface of the disk is attacked to some extent during this initial phase of production.

After treatment in NaOH (sodium hydroxide), the aluminium disks are washed in water and conveyed directly to the drying phase which is followed by a "rolling" process by means of a set of four rolling machines, the first two of which spread the above product (P) on the aluminium disks; said product (P) binds to the smooth metal surface with a mechanical-chemical action, consequently becoming the anchoring surface for the external P.T.F.E. coating.

After the initial degreasing phase, it is recommended, but not absolutely necessary, to place the parts very briefly in an acid bath (10–12 seconds) in order to remove any soda residues which might damage the system.

The product (P) which has this functional bivalence is obtained by mixing a polyamide-imide resin (know on the market as RHODEFTAL 200) with dimethylaminoethanol (commercial name REXOLIN) and water in the following percentages:

| | |
|---|---|
| A - RHODEFTAL 200 (Polyamide-imide) | 35.714% |
| B - REXOLIN (dimethylaminoethanol) | 7.143% |

-continued

| | |
|---|---|
| C - WATER | 57.143% |

The mixture percentage of component (A) with respect to component (B) may vary by plus or minus 5%, as may do the mixture percentage of component (C) with respect to the sum of the components (B+C).

According to the procedure in question, in the first rolling machine, this product (P) is used mixed with a thickening solution and colouring pigments, while in the second rolling machine the P.T.F.E. is added to the mixture used on the first rolling machine; in the last two rolling machines, an aqueous solution of P.T.F.E. is used with the addition of pigments.

The mixture used in the first rolling machine consists of the following components in the following percentages:

| | |
|---|---|
| Product (P) | 80% |
| thickening solution + colouring pigments | 20% |

The mixture percentage of product (A) with respect to component (B) may vary by plus or minus 5%.

The percentage of pigments in the thickening solution may vary from 8–12%.

The mixture used in the second rolling machine consists of the following components in the following percentages:

| | |
|---|---|
| Product (P) | 50% |
| P.T.F.E. (commercial name HOSTAFLON) | 25% |
| thickening solution + colouring pigments | 25% |

The mixture percentage of Product (P) with respect to the sum of the other two components may vary by plus or minus 5%.

The mixture used in the third and fourth roller is a standard aqueous solution of P.T.F.E. and colouring pigments.

The thickening solution in the mixture used in the first and in the second rolling machine consists of the following components in the following percentages:

| | |
|---|---|
| D - ISOBUTYL alcohol | 11.4% |
| E - SOLVENT S11 (dichloropropane hexane) | 9.5% |
| F - EMPILAN NP9 (alkylphenolethyhoxylate) | 79.1% |

The mixture percentage of the component (F) with respect to the sum of the components (D+E) may vary by plus or minus 8%.

Considering the above, the advantages offered by the procedure according to the invention are now more appreciable.

In preparing the metal surface it is not necessary to attack the same in depth and therefore the disks do not need to be dipped in solutions but simply sprayed with solutions as in the case of standard wash tunnels.

If, for reasons of the investment, the former dipping system is to be continued, there will still be a reduction in management costs and times; in fact the system processing times are significantly reduced (from the current twenty minutes to three minutes with the procedure according to the invention), while the solutions used in this new procedure can treat major surface areas thereby reducing the purchasing costs of the solution and of the costs for treating depleted solutions and the muds produced.

On the whole, the entire process for application of the P.T.F.E. film is faster in that the times required for preparing the aluminium surfaces are lower.

I claim:

1. A procedure for the application of polytetrafluoroethylene film on aluminum surfaces comprising the following sequence of production phases:

a) degreasing the aluminum surfaces in an aqueous solution;

b) washing with water;

c) an optional rapid bath in a hydrochloric acid solution followed by rinsing in water;

d) drying;

e) applying the film on the aluminum surfaces by a rolling process through a set of four machines in which:

I) the mixture used in the first rolling machine consists of:

| | |
|---|---|
| Product | 80% by weight |
| thickening solution + coloring pigments | 20% by weight |

II) the mixture used in the second rolling machine consists of:

| | |
|---|---|
| Product | 50% by weight |
| polytetrafluoroethylene | 25% by weight |
| thickening solution + coloring pigments | 25% by weight |

III) the mixture used in the third and fourth rolling machines is an aqueous solution of polytetrafluoroethylene and coloring pigments; whereby the product consists of the following components in the following percentages:

| | |
|---|---|
| A) Polyamide-imide | 35.714% by weight |
| B) dimethylaminoethanol | 7.143% by weight |
| C) water | 57.143% by weight |

whereby the thickening solution in the mixture used in the first and second rolling machines consists of the following components in the following percentages:

| | |
|---|---|
| D) isobutyl alcohol | 11.4% by weight |
| E) dichloropropane hexane | 9.5% by weight |
| F) alkylphenolethoxylate | 79.1% by weight. |

2. A procedure for the application of polytetrafluoroethylene film on an aluminum surface by a rolling process comprising the steps of:

first degreasing the aluminum surface with an aqueous alkaline solution, washing the degreased aluminum surface with water and drying the aluminum surface, second applying a mixture of a product and a thickening solution to the aluminum surface wherein the product is a mixture of polyamide-imide, dimethylaminoethanol and water and the thickening solution is a mixture of isobutyl alcohol, dichloropropane hexane and alkylphenolethoxylate, third, applying a mixture of the product, the thickening solution and polytetrafluoroethylene to the aluminum surface, and fourth, applying an aqueous solution of polytetrafluoroethylene to the aluminum surface, wherein, in the mixture in the second step, the product is 80% by weight and the thickening solution is 20% by weight and in the mixture in the third step, the product is 50% by weight, the thickening solution is 25% by weight and the polytetrafluoroethylene is 25% by weight.

3. The procedure of claim 2, wherein, in the product, the percentage by weight of the polyamide-imide is 35.714%, the percentage by weight of the dimethylaminoethanol is 7.143% and the percentage by weight of the water is 57.143%.

4. The procedure of claim 2, wherein, in the thickening solution, the percentage by weight of the isobutyl alcohol is 11.4%, the percentage by weight of the dichloropropane hexane is 9.5% and the percentage by weight of the alkylphenolethoxylate is 79.1%.

5. The procedure of claim 2, wherein a set of four rolling machines are used, the first application using a first rolling machine, the second application using a second rolling machine, the aqueous solution of the polytetrafluoroethylene being applied using a third rolling machine and a fourth rolling machine.

6. The procedure of claim 2, further adding coloring pigments to the solutions applied to each rolling machine.

* * * * *